US012366248B2

(12) United States Patent
Santarossa

(10) Patent No.: US 12,366,248 B2
(45) Date of Patent: Jul. 22, 2025

(54) VOLUMETRIC LOBE COMPRESSOR FOR AN EQUIPMENT AND/OR A SUCTION COMPRESSION PLANT OF MATERIAL IN LIQUID, GASEOUS, SOLID, POWDER, OR SLURRY FORM

(71) Applicant: Jurop S.p.A., Azzano Decimo (IT)

(72) Inventor: Danilo Santarossa, Azzano Decino (IT)

(73) Assignee: JUROP S.P.A., Azzano Decimo (IT)

( * ) Notice: Subject to any disclaimer, the term of this patent is extended or adjusted under 35 U.S.C. 154(b) by 0 days.

(21) Appl. No.: 18/564,660

(22) PCT Filed: Jun. 3, 2022

(86) PCT No.: PCT/IB2022/055203

§ 371 (c)(1),
(2) Date: Nov. 28, 2023

(87) PCT Pub. No.: WO2022/254400

PCT Pub. Date: Dec. 8, 2022

(65) Prior Publication Data

US 2024/0376893 A1 Nov. 14, 2024

(30) Foreign Application Priority Data

Jun. 4, 2021 (IT) ..... 102021000014648

(51) Int. Cl.
*F04C 29/00* (2006.01)
*F04C 18/12* (2006.01)
(Continued)

(52) U.S. Cl.
CPC ..... *F04C 18/126* (2013.01); *F04C 29/02* (2013.01); *F04C 29/04* (2013.01); *F04C 2240/30* (2013.01)

(58) Field of Classification Search
CPC ..... F04C 18/126; F04C 18/14; F04C 18/16; F04C 29/02; F04C 29/047; F04C 29/021; F04C 29/12; F04C 25/02
See application file for complete search history.

(56) References Cited

U.S. PATENT DOCUMENTS

2012/0121442 A1 5/2012 Kim
2020/0173496 A1* 6/2020 Wild ..... F04D 29/5893

FOREIGN PATENT DOCUMENTS

CN 103089647 A * 5/2013 ..... F04C 18/126
EP 573063 A1 12/1993

OTHER PUBLICATIONS

English translation of CN 103089647 by PE2E Aug. 27, 2024.*

* cited by examiner

*Primary Examiner* — Deming Wan
(74) *Attorney, Agent, or Firm* — Patterson Intellectual Property Law, PC

(57) ABSTRACT

The present invention concerns a volumetric compressor (1) that can be used, preferably, for producing equipment and/or a plant for the suction of material in liquid, solid, powder or slurry form. The compressor according to the invention comprises a body (2) defining an operative chamber (5), a suction section (51) and a discharge section (52) of an operating fluid. The compressor further comprises at least two lobe rotors (8A. 8B), the lobes (81A. 81B) of which are housed inside said operative chamber (5), each rotor (8A. 8B) rotating around a corresponding longitudinal rotation axis (101A. 101B). The compressor comprises a first header (6) and a second header (6') which delimit on opposite sides the operative chamber (5): each header comprises a bank (61, 61') connected to the body (2) and configured to support the rotors (8A, 8B) and a cover (62, 62') connected to the bank (61, 61') so as to define an inner volume (65, 65')
(Continued)

comprised between the cover (62, 62') and the bank (61, 61') and designed to house, in use, a lubricating bath. According to the invention the compressor comprises a generator unit for generating a forced flow of cooling gas and, for at least one of the headers (6, 6'), the bank (61, 61') defines a cooling chamber (70, 70') physically separated from the operative chamber (5) and from the inner volume of lubricant. Said chamber (70, 70') comprises an inlet (71, 71') and an outlet (72, 72') for a cooling gas, where said inlet communicates with the generator unit of the forced flow of said cooling gas.

18 Claims, 10 Drawing Sheets

(51) Int. Cl.

| | |
|---|---|
| ***F04C 18/14*** | (2006.01) |
| ***F04C 18/16*** | (2006.01) |
| ***F04C 29/02*** | (2006.01) |
| ***F04C 29/04*** | (2006.01) |

VOLUMETRIC LOBE COMPRESSOR FOR AN EQUIPMENT AND/OR A SUCTION COMPRESSION PLANT OF MATERIAL IN LIQUID, GASEOUS, SOLID, POWDER, OR SLURRY FORM

FIELD OF THE INVENTION

The present invention falls within the field of the production of volumetric compressors, particularly but not exclusively intended for the production of equipment and/or plants for suction/compression of material in liquid, gaseous, solid, powder or slurry form. In particular, the invention relates to a volumetric lobe compressor with improved heat dissipation capability.

State of the Art

In the field of the production of equipment for collecting wet and/or dry materials, volumetric compressors are commonly used such as, for example, those described in the patent applications EP3106611, EP3106610 and EP3332123 in the name of the same Applicant. A volumetric compressor typically comprises a main body defining a work chamber housing two rotors with lobes that are usually straight or helical. The body defines a suction section and a discharge section for discharging an operating fluid and it is closed at the ends by two headers.

Each header comprises a first portion, also defined as bank, connected to the body so as to define a corresponding transverse closing surface for the work chamber. At the first portion the bearings (supports) supporting the rotors are installed so as to allow them to rotate around the corresponding axes. Each header also comprises a second portion, connected to the first portion on the opposite side with respect to the main body. Typically, said second portion is cover-shaped and, once connected to the first portion, defines a volume for an oil bath for lubricating the supports of the rotors installed in the bank.

At a first header, a transmission mechanism, which allows rotation of the rotors, is arranged. This mechanism is operated by an external motor directly or indirectly connected to one of the two rotors. The transmission mechanism is configured so as to allow the two rotors to rotate at the same speed. Said mechanism is arranged in the volume defined by the second portion of said first header so that it is partially immersed in the oil bath contained therein. As it is known, volumetric compressors can operate according to a "pressure" operating mode and according to a "vacuum" operating mode. Typically, in the pressure operating mode the machine compresses the air from the suction section, at atmospheric pressure, to the discharge section with a pressure variation of 1-1.5 Bar. In the "vacuum" operating mode, the compressor compresses the air from the suction section (in depression) to the discharge section typically at atmospheric pressure.

In any case, compression of the air between the suction section and the discharge section is accompanied by an increase in temperature. Therefore, the temperature of the body at the discharge section is markedly higher than the temperature at the suction section, and can even reach 150-170° C. This temperature difference between suction and discharge creates a thermal distortion inside the main body, causing it to bend and elongate on the side of the discharge section. This distortion causes misalignment of the rotor supports and more generally a deterioration in the operating conditions which, among the other drawbacks, reduces the life of the supports.

In addition to this, the heating of the body is obviously also transferred to the headers and in particular to the oil bath contained by the portion configured as a cover. The temperatures of the oil can reach values slightly lower than or equal to those reached in the area of the discharge section (i.e., values in the range 150-170°° C. indicated above) also in a short space of time, depending for example on the rotation speed set for the rotors. These temperature values are critical for the stability of the oil and therefore the oil has to be frequently replaced to guarantee operation of the compressor. Apart from maintenance costs, this aspect is extremely disadvantageous in terms of environmental impact in view of the need to manage and dispose of large amounts of oil.

In order to limit the temperature increase, a first well-known solution provides for introduction of an air flow into the work chamber, the effect of which is to cool the rotors. In particular, the air is introduced into a volume of the work operative chamber defined between two lobes of a rotor and the transverse closing walls defined between the two headers, i.e., a volume that is not in communication either with the suction section or with the discharge section.

In the application EP3106611 in the name of the Applicant, air is injected into the work chamber frontally, i.e. through openings in the main body. In the solution described in EP 3332123, again in the name of the Applicant, the air is injected laterally, i.e. by means of the apertures that pass through the transverse surfaces of the headers delimiting the work chamber in a longitudinal direction. In particular, the first portion of the headers defines a passage through which the air under pressure directly reaches the injection apertures and therefore the work chamber.

The solution described in EP3332123 limits heating of the body and at the same time significantly reduces the pressure fluctuations and/or the fluctuations at the discharge which typically represent a problem in the solutions with frontal injection. However, the solution described in EP3332123 can only be used when the volumetric compressor operates in the "vacuum" operating mode since the pressure (Pc) inside the compressor is lower than the atmospheric pressure (Pa) outside the compressor. In this condition, the injection air can enter from the outside, cooling the compressor body. In the pressure mode, on the other hand, the compressor operates in the opposite condition, i.e. Pc>Pa. Therefore, on one side the injection air cannot naturally enter the compressor and on the other, the air in the compressor tends to flow out of the injection openings. To prevent this air outflow, a check valve has to be provided. Therefore, with reference to temperature limitation, the solution provided in EP 3332123 is wholly ineffective for the pressure operating mode.

Another known solution used to limit the heating entails cooling the body and/or the headers via an air flow that laps their outer surfaces. In this regard, the patent U.S. Pat. No. 6,817,844 describes a compressor in which for each header an air space is defined between the header and a casing that surrounds the header. For each header, this air space is crossed by air forced through a fan installed in the rotation shaft of the rotor operated by the compressor motor. As it crosses the air space, the air removes heat from the outer walls of the header, thus limiting the heating thereof. On the one hand this solution can be used for both operating modes (vacuum and pressure) but on the other, the provision of the air space considerably complicates the design and production of the compressor, making the solution industrially unfeasible.

Other known solutions are described in the patent applications US 2012/0121442 A1 and EP 0 573 063 A1.

US 2012/0121442 A1 describes a dry vacuum multistage pump in which the body and rotor are cooled by circulating water inside a plurality of cooling water jackets. The jackets are obtained, respectively, in the front and rear covers, and in the pump body and are arranged around and in the vicinity of the passage of gas circulating inside the pump. The water cooling entails the presence of devices such as, for example, radiator, pipes, pumps, which increase the overall dimensions and weight of the pump, making the solution industrially unfeasible.

EP 0 573 063 A1 describes a bearing lubrication structure for a rotary machine comprising a closed cooling jacket, namely without inlet and outlet, obtained in the casing of the structure and designed to cool the bearing lubrication oil present inside the casing.

From the above, the need therefore emerges for a new technical solution that overcomes the drawbacks described above, in particular limits overheating of the compressor headers regardless of the compressor operating mode.

SUMMARY

The main task of the present invention is to provide a volumetric compressor that overcomes the drawbacks indicated above. In this context, a first object of the present invention is to provide a volumetric compressor with improved heat dissipation capabilities, in particular in terms of the headers. A further object, linked to the preceding one, is to provide a compressor in which said heat dissipation concerns in particular the lubricating oil used in the headers for lubricating the supports. A further object is to provide a compressor in which the heat dissipation is obtained in a simple manner and without complicating the structure of the headers. A further object, linked to the preceding one, is to guarantee that the heat is dissipated regardless of the compressor operating mode. Last but not least, a further object is to provide a compressor which is reliable and easy to produce at competitive costs.

The Applicant has found that the task and the objects indicated above can be achieved by providing a chamber (with an inlet and an outlet) that passes through the bank of a corresponding header and by causing a cooling gas to flow in a forced manner through said chamber so as to remove heat from the walls of the bank. In other words, the idea underlying the invention is to define a cooling chamber within the bank so as to remove heat both from the oil bath (at higher temperature) and from the body (at a temperature equal to or lower than the oil bath).

In particular, the task and the objects of the invention are achieved through a volumetric compressor comprising:

- a body defining an operative chamber, a suction section and a discharge section of an operating fluid;
- at least two lobe rotors, the lobes of which are housed inside said operative chamber, each rotor rotating around a corresponding longitudinal axis of rotation;
- a first header and a second header that delimit on opposite sides the operative chamber, in which each of the headers comprises a bank, connected to the body and configured to support the rotors, and a cover connected to the bank so as to define an inner volume between the cover and the bank and able to house, in use, a lubricating bath.

According to the invention, the compressor comprises a generator unit for generating a forced flow of gas and, for at least one of said headers, the bank defines a cooling chamber physically separate from the operative chamber and from the inner volume, in which the cooling chamber comprises an inlet and an outlet for said forced flow of cooling gas, in which said inlet communicates with said generator unit so that said cooling chamber is crossed by said forced flow of cooling gas produced by said generator unit.

During its passage inside the cooling chamber, the cooling gas removes heat (through heat exchange by convection) from the walls of the bank and consequently from the lubricating oil bath and/or from the body of the compressor which are in contact with the bank. Advantageously, the cooling chamber is defined inside the bank and is therefore completely integrated in the structure thereof. Furthermore, the cooling chamber is physically isolated from the operative chamber. Therefore, the cooling gas can flow regardless of the compressor operating mode, i.e. during both vacuum and pressure operation.

In accordance with one embodiment, the inlet and the outlet of the cooling chamber are arranged on opposite sides with respect to a reference plane containing the rotation axes of the lobe rotors. This arrangement ensures a more uniform flow of the cooling gas inside the cooling chamber and therefore an equally uniform thermal exchange with the walls of the bank.

In accordance with a possible embodiment, the outlet of the cooling chamber is defined in a position near to the suction section of said body, while the inlet is defined in a position near to the discharge section of said body. Via this arrangement, the gas flowing out of the cooling chamber is substantially in counter-current with respect to the gas flow entering the suction section of the body. This condition improves thermal distribution in the compressor body, reducing the thermal distortion.

In accordance with a possible embodiment, the generator unit generating the forced cooling gas flow comprises at least one operating machine driven independently of said rotors of said compressor. Via this solution the flow rate of the cooling gas through the cooling chamber can be increased as the rotor rotation speed decreases, or vice versa reduced as the rotor rotation speed increases. In short, the cooling gas flow rate can be adjusted according to the greater or lesser overheating that could occur depending on the rotor rotation speed. This solution allows the compressor efficiency to be increased also at low rotation speeds.

According to a possible embodiment, the bank is defined by a first portion and by a second portion connected to each other and configured so as to define, after their connection, said cooling chamber, in which said first portion is connected to the body and said second portion is connected to said cover. The configuration with two bank portions advantageously facilitates the design and definition of the cooling chamber. Furthermore, this configuration facilitates installation of the supports for rotation of the rotors and the definition of channels for lubrication of the supports.

In accordance with a possible embodiment, the second portion of the bank is made of a material having a thermal conductivity higher than the material used to produce the first portion of the same bank. This solution allows dissipation of the lubricating bath heat to be prioritised over that of the body, with the advantage of prolonging the life of the oil. In accordance with an embodiment, on the inner side of one of the two portions of the bank, ribs are defined which develop towards the inside of the cooling chamber, thus increasing the thermal exchange surface with said cooling gas and consequently increasing the heat dissipated.

According to a possible embodiment, for each compressor header, the corresponding bank defines a cooling chamber physically separated from the operative chamber and from the corresponding inner volume; each cooling chamber comprises an inlet and an outlet for a cooling gas, and for each cooling chamber the inlet communicates with the generator unit generating said forced flow of cooling gas so that each cooling chamber is crossed by a forced flow of cooling gas.

In accordance with a possible embodiment, the unit generating the forced flow of cooling gas comprises a first operating machine and a second operating machine each of which is directly or indirectly connected to a corresponding bank so that its delivery communicates with the inlet of the corresponding cooling chamber defined by the bank.

Preferably, the two operating machines are arranged on the same side with respect to a reference plane containing the rotation axes of the rotors.

In a possible embodiment, each operating machine is connected to a corresponding bank through a coupling sleeve which connects the delivery of the operating machine to the inlet of the corresponding cooling chamber.

According to another embodiment, the unit generating the forced flow of cooling gas comprises an operating machine and a supply conduit communicating with the delivery of the operating machine and defining two outlet sections each directly or indirectly communicating with an inlet of a corresponding cooling chamber.

The present invention also concerns fixed or movable equipment for the suction of material in liquid, gaseous, solid, powder or slurry form, characterised in that it comprises a volumetric compressor according to any one of the embodiments indicated above.

LIST OF FIGURES

Further characteristics and advantages of the invention will become evident from examination of the following detailed disclosure of some preferred but non-exclusive embodiments of the volumetric compressor, illustrated by way of non-limiting example, with the support of the attached drawings, in which.

The same numbers and the same reference letters in the figures identify the same elements or components.

DETAILED DISCLOSURE

Figure 1:
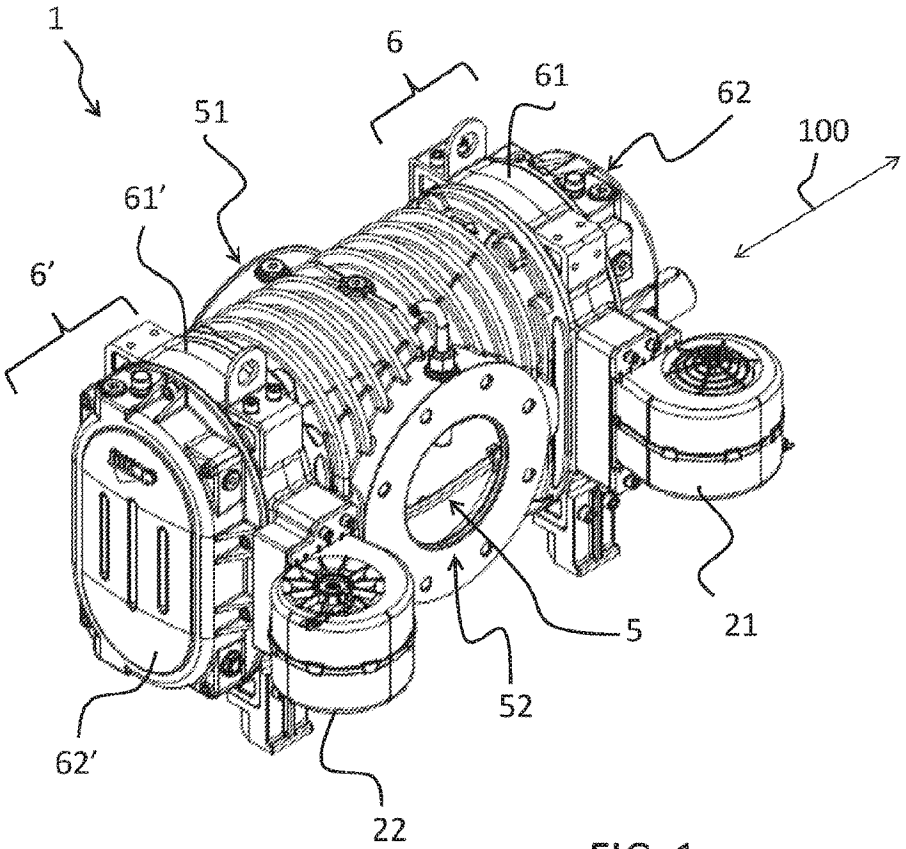
FIGS. 1 and 2 are perspective views of a possible embodiment of a volumetric compressor according to the present invention.

With reference to the cited figures, the present invention concerns a volumetric compressor generically indicated by the reference 1. The compressor 1 comprises a body 2 defining an operative chamber 5 (or work chamber 5). The latter develops in a longitudinal direction 100. The body 2 also defines a suction section 51 and a discharge section 52 of the operative chamber 5. The two sections 51, 52 are configured respectively for suction and discharge of an operating fluid, for example air or other gas. The compressor 1 comprises at least two lobe rotors 8A, 8B, in which said lobes 81A, 81B are housed inside the work chamber 5. Each rotor 8A, 8B rotates around a corresponding rotation axis 101A, 101B which is substantially parallel to the longitudinal direction 100 of development of the work chamber 5.

The form of the rotors 8A, 8B is not important for the purposes of the present invention. The rotors 8A, 8B could have straight lobes or alternatively the lobes could develop according to a substantially helical profile, as in the embodiment shown in the figures. Also the number of lobes of the rotors is not important. In fact, the rotors 8A, 8B could have two lobes or three lobes 81A, 81B (as in the solution shown in the figures) or also a greater number of lobes. In any case, the rotors 8A, 8B comprise two end parts 83A-84A, 83B-84B defining the corresponding rotation axis 101A, 101B and a central part between said end parts and defining the lobes 81A, 81B. The parts of the rotors 8A, 8B indicated above are evaluated in the longitudinal direction 100.

The compressor 1 comprises a first header 6 and a second header 6' connected to the body 2 on opposite sides so as to delimit longitudinally the operative chamber 5. The two headers 6, 6' support the two rotors 8A, 8B in the area of their end parts 83A-84A, 83B-84B.

More precisely, each header comprises a first part 61, 61' directly connected to the body 2 and indicated below by the term "bank". Each header 6, 6' also comprises a second part 62, 62' connected to the corresponding bank 61, 61' and indicated below by the term "cover". For each header 6, 6', the corresponding bank 61, 61' is comprised between the body 2 and the corresponding cover 62, 62' and supports the two rotors 8A, 8B in the area of their end parts 83A-84A, 83B-84B. Furthermore, for each header 6, 6', the corresponding cover 62, 62' is configured so as to define, once it has been connected to the corresponding bank 61, 61', an inner volume 65, 65' which can contain, in use, a lubricating oil bath. In practice, said inner volume 65, 65' is defined, and therefore comprised, between the corresponding cover 62, 62' and the corresponding bank 61, 61'.

According to the present invention, for at least one of the two headers 6, 6', preferably for both, the corresponding bank 61, 61' defines a cooling chamber 70, 70' physically separate from the work chamber 5 and from the inner volume 65, 65' defined above. Said cooling chamber 70, 70' comprises an inlet 71, 71' and an outlet 72, 72', communicating with the inlet 71, 71', respectively to allow a cooling gas (preferably, but not exclusively, air) to enter, flow through and out of the cooling chamber 70, 70'. According to the invention, the inlet 71, 71' is connected to a forced flow generator unit 21, 22 of the compressor 1, which is configured to generate a forced flow of cooling gas to the inlet 71, 71' of the cooling chamber 70, 70'. In other words, the forced flow generator unit 21, 22 has the function of forcing the cooling gas into the cooling chamber 70, 70'.

In particular, according to the invention, the inlet 71, 71' and the outlet 72, 72' are both configured by the bank 61, 61' so that the cooling gas flow passes through the cooling chamber 70, 70' without entering the work chamber 5. As it passes through the cooling chamber 70, 70', the cooling gas laps the walls of the corresponding bank 61, 61', removing heat by convection. As better specified below, it has been seen that this solution limits heating of the oil contained in the inner volume 65, 65' with the advantage of prolonging the life of the oil. In addition to this, the invention leads to a reduction in the heating of the body 2 of the compressor 1, in particular at the discharge section 52. In any case, the cooling chamber 70, 70' defines an empty space between the body 2 and the warmer portion of the header 6, 6' containing the lubricating oil. Said empty space, crossed by the cooling gas, forms a type of barrier that limits transmission of the heat from the lubricating oil to the body 2 and vice versa.

In accordance with a preferred embodiment, the inlet 71, 71' and the outlet 72, 72' of the cooling chamber 70, 70' are defined on opposite sides of the bank 61, 61' with respect to the reference plane 200 defined above. Preferably, the inlet 71, 71' is defined in a position near to the discharge section 52 of the body 2, while the outlet 72, 72' is defined in a position near the suction section 51 of the body 2. It has been seen that this solution allows a more uniform distribution of the temperatures inside the body 2 and therefore lower thermal distortion. In fact, the gas flowing out of the cooling chamber 70, 70' increases the temperature of the area of the body 2 adjacent to the suction section 51, where the operating fluid has a lower temperature than the discharge section 52. At the same time, the cold cooling gas flowing into the cooling chamber 70, 70' reduces, or in any case does not increase, the temperature of the body 2 at the discharge section 52.

In the context of the present invention, the generator unit generating the forced flow of cooling gas comprises at least one operating machine (for example a blower or a fan) provided with an impeller driven by a motor, for example an electric motor, with the purpose of generating in delivery an air flow to the inlet of the cooling chambers 70, 70'. According to a possible preferred embodiment, said operating machine is driven independently of the rotors 8A, 8B of the compressor 1. In this operating condition, the number of revolutions of the operating machine, i.e. the rotation speed of the corresponding impellers, can be adjusted (i.e. increased or decreased) independently of the rotation speed, i.e. of the number of revolutions of the rotors 8A, 8B.

Figure 2:
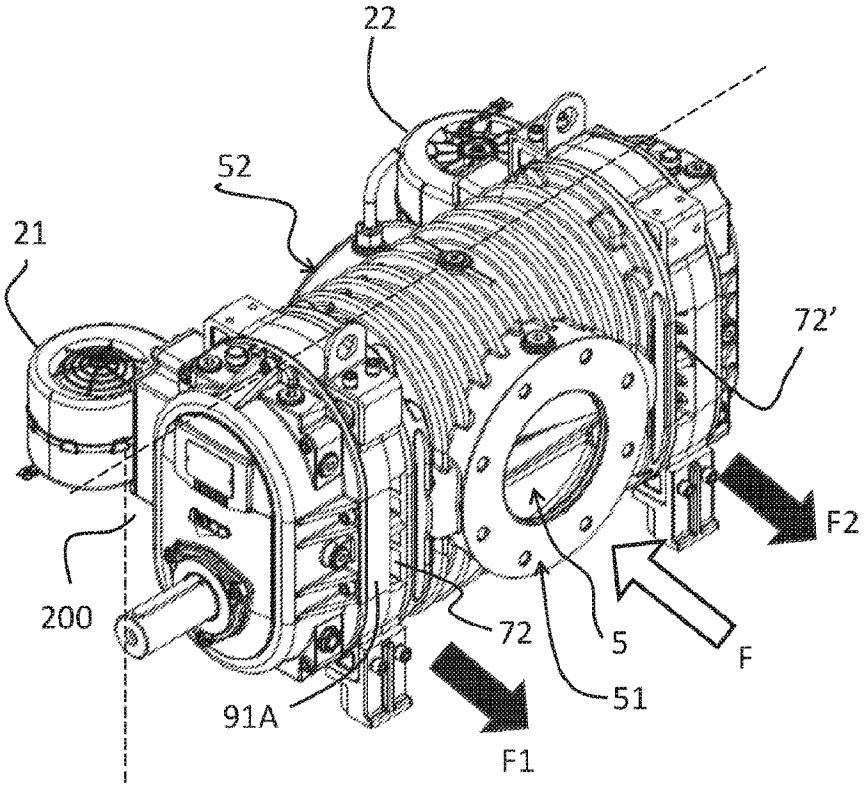
Figure 3:
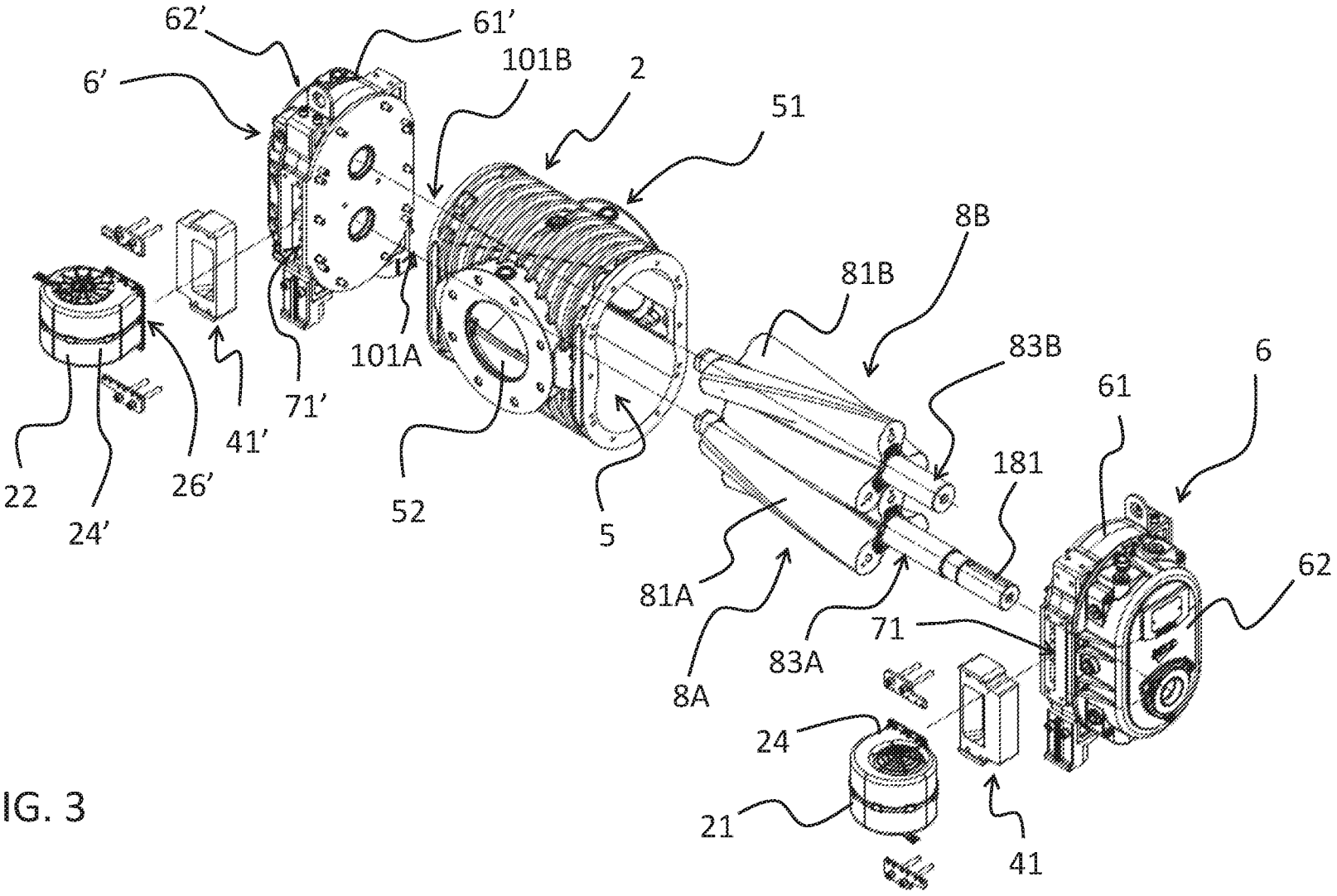
FIG. 3 is an exploded view of the compressor of FIGS. 1 and 2.
Figures 4, 5:
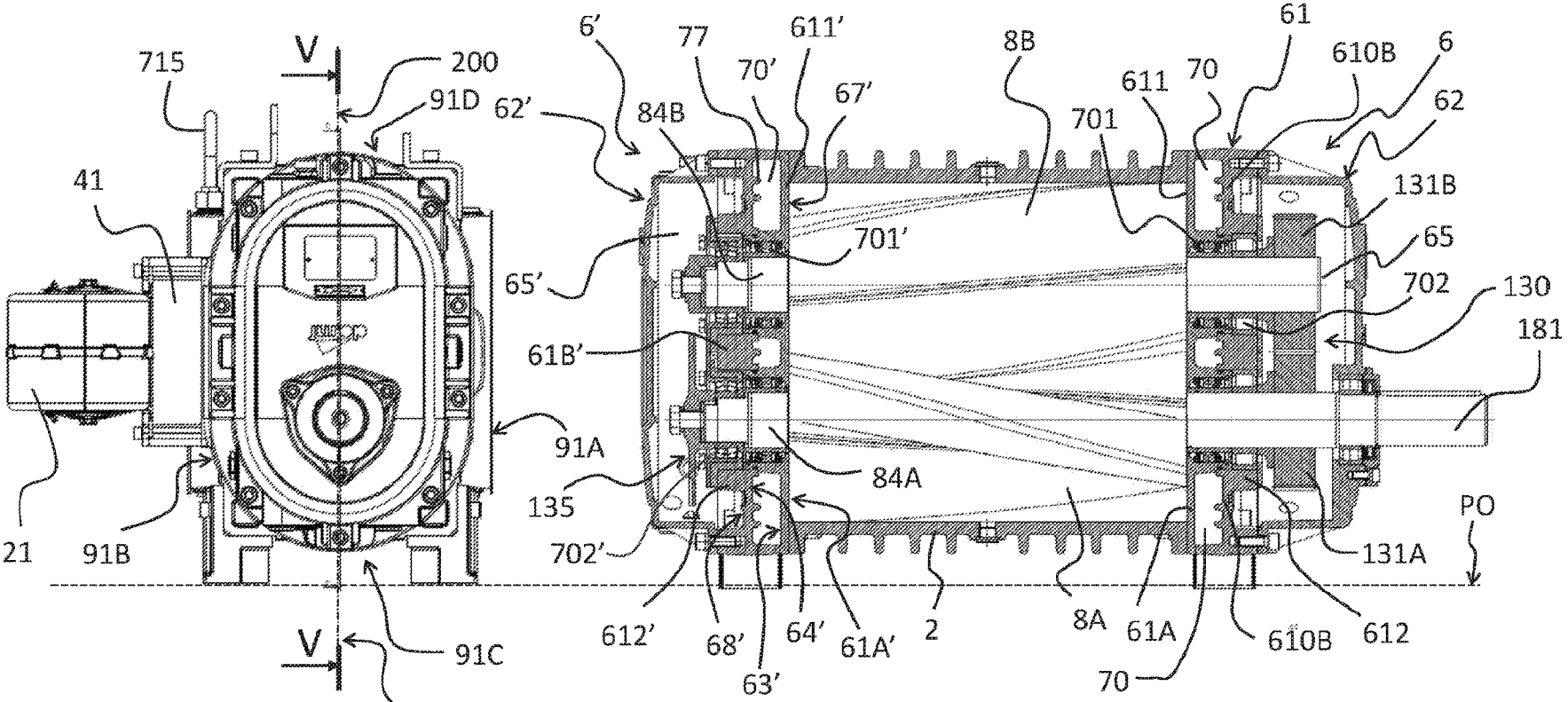
FIG. 4 is a frontal view of the compressor of FIGS. 1 and 2.
FIG. 5 is a section view according to the line V-V of FIG. 4.

FIGS. 1 and 2 are perspective views, from different observation points, of a compressor 1 in accordance with a first possible embodiment. FIG. 5 is a section view of the same compressor 1 according to a reference plane 200 containing the axes 101A, 101B of the rotors 8A, 8B. In the compressor 1 a first header 6 can be identified comprising a first bank 61 and a first cover 62 and a second header 6' comprising a second bank 61' and a second cover 62'. As indicated above, the two headers 6, 6' are connected to opposite sides of the body 2 via the corresponding banks 61, 61'.

In the first header 6 a first inner volume 65 can be identified configured between the first bank 61 and the first cover 62. In the second header 6' a second inner volume 65' can be identified between the second bank 61' and the second cover 62'. Both the inner volumes 65, 65' contain an oil bath for lubricating the supports/bearings 701-701', 702-702' mounted on the corresponding bank 61, 61' and allowing rotation of the rotors 8A, 8B.

According to a possible embodiment, one of the two inner volumes 65, 65' defined above houses a motion transmission unit 130, configured to mechanically connect the two rotors 8A, 8B. In accordance with a solution known per se, the transmission unit 130 is configured to rotate the rotors 8A, 8B in a synchronous manner but in opposite direction. In the case illustrated in the figures (see in particular FIG. 5), the transmission unit 130 comprises a pair of gear wheels 131A, 131B arranged in the inner volume 65 of the first header 6 and each of which is fitted on an end part 83A, 83B of a corresponding rotor 8A, 8B. The two gear wheels 131A, 131B have the same diameter to guarantee that the two rotors 8A, 8B rotate with the same angular velocity.

According to another aspect, at least one of the two covers 62, 62' comprises an opening 620 (indicated in FIG. 8) from which a free end 181 of one of the two rotors protrudes, preferably the one nearest a support plane PO to which the compressor 1 is fixed. With reference to FIG. 5, in the case illustrated, the free end 181 of the first rotor 8A protrudes from the first cover 62 of the first header 6, i.e. from the one that defines the inner volume 65 in which the transmission unit 130 is housed. However, in an alternative embodiment, the free end of one of the rotors could protrude from the opposite cover from the one defining the housing for the transmission unit. At the same time, said end could be that of the rotor farthest from the support plane PO of the compressor.

According to a possible embodiment, the inner volume of the header opposite the header containing the transmission unit 130 houses an oil spreader disc 135 fitted at the end of one of the two rotors, preferably the lower rotor 8A nearest the support plane PO. The function of the oil spreader disc is known per se to a person skilled in the art. With reference to FIG. 5, in the case illustrated the oil spreader disc 135 is fitted at the end of the first rotor 8A and is housed in the inner volume 65' of the second header 6'.

According to a preferred embodiment, shown in the figures, for each of the two headers 6, 6', the corresponding bank 61, 61' defines a corresponding cooling chamber 70, 70'. In particular, a first cooling chamber 70, defined by the first bank 61 of the first header 6, can be identified and a second cooling chamber 70', defined by the second bank 61' of the second header 6', can be identified. Each cooling chamber 70, 70' comprises a corresponding inlet 71, 71' and a corresponding outlet 72, 72' communicating with each other. According to the invention, each inlet 71, 71' communicates with the flow generator unit so that the inlets 71, 71' of both the cooling chambers 70, 70' are supplied with a flow of cooling gas.

With reference to FIG. 1, the inlets 71, 71' of the two cooling chambers 70, 70' are preferably defined on the same side with respect to the reference plane 200 defined above. In particular, they are preferably positioned near the discharge section 52 of the body 2. Analogously, the outlets 72, 72' of the two cooling chambers 70, 70' are defined on the opposite side, again with respect to the reference plane 200 (indicated in FIG. 2). The outlets 72, 72' are defined in a position near the suction section 51 of the body 2. Due to this arrangement, the cooling gas flows F1-F2 flowing out of the cooling chambers 70, 70' are substantially in counter-current with respect to the flow F of the operating fluid that passes through the work chamber 5. As mentioned above, this configuration leads to improved temperature distribution inside the body 2 and therefore a reduction in thermal distortions. In accordance with a preferred embodiment, shown in the figures, the flow generator unit comprises a first operating machine 21 and a second operating machine 22

(indicated below also by the terms first blower 21 and second blower 22) communicating respectively with the inlet 71 of the first cooling chamber 70 and with the inlet 71' of the second cooling chamber 70'. Preferably, the two blowers 21, 22 are arranged on the same side with respect to the reference plane 200 containing the rotation axes 101, 101' of the two rotors 8, 8' (see for example FIG. 1).

In an alternative embodiment, not shown in the figures, with respect to the reference plane 200 the inlet 71 and the outlet 72 of the first cooling chamber 70 could be on opposite sides with respect to the inlet 71' and the outlet 72' of the second cooling chamber 70'. In this case, also the two blowers 21, 22 could be installed on opposite sides with respect to said reference plane 200.

Preferably the two blowers 21, 22 are driven independently of the rotors 8A, 8B of the compressor 1, i.e. so that the rotation speed of the corresponding impellers can be set regardless of the number of revolutions of the rotors 8A, 8B. Via this solution it is therefore possible to increase the number of revolutions of the blowers 21, 22, i.e. the flow rate of the flows through the cooling chambers 70, 70', when the rotation speed of the rotors 8A, 8B is low, i.e. when the compressor 1 is subject to greatest heating. Alternatively, it is possible to reduce the flow rate of the flows through the cooling chambers 70, 70' when the rotation speed of the rotors 8A, 8B is high.

According to an embodiment, the two blowers 21, 22 each comprise a corresponding volute 24, 24' that guides the flow generated through the corresponding impeller 25, 25' and defines the delivery of the same blower. As shown in the figures, for each blower 21, 22, a coupling sleeve 41, 41' is provided to connect the delivery (meaning the volute) 24, 24' of a blower 21, 22 to the inlet 71, 71' of the corresponding cooling chamber 70, 70'. For each header 6, 6' of the compressor 1, the coupling sleeve 41, 41' is internally hollow and is fixed, at a first side thereof, on the bank 61, 61' at of the inlet 71, 71' of the cooling chamber 70, 70'. For each blower 21, 22, the volute 24, 24' is fixed on a second side of the coupling sleeve 41, 41', opposite the first, so that the flow generated by the blower 21, 22 in delivery is conveyed into the cooling chamber 70, 70' through the sleeve itself. Advantageously, the use of a coupling sleeve 41, 41' allows the use of readily available blowers as it represents a low cost connection interface that is easy to produce.

However, the present invention also comprises the possibility of connecting the volute 24, 24' of the blower 21, 22 directly to the corresponding bank 61, 61' without using a coupling sleeve.

Figure 10:
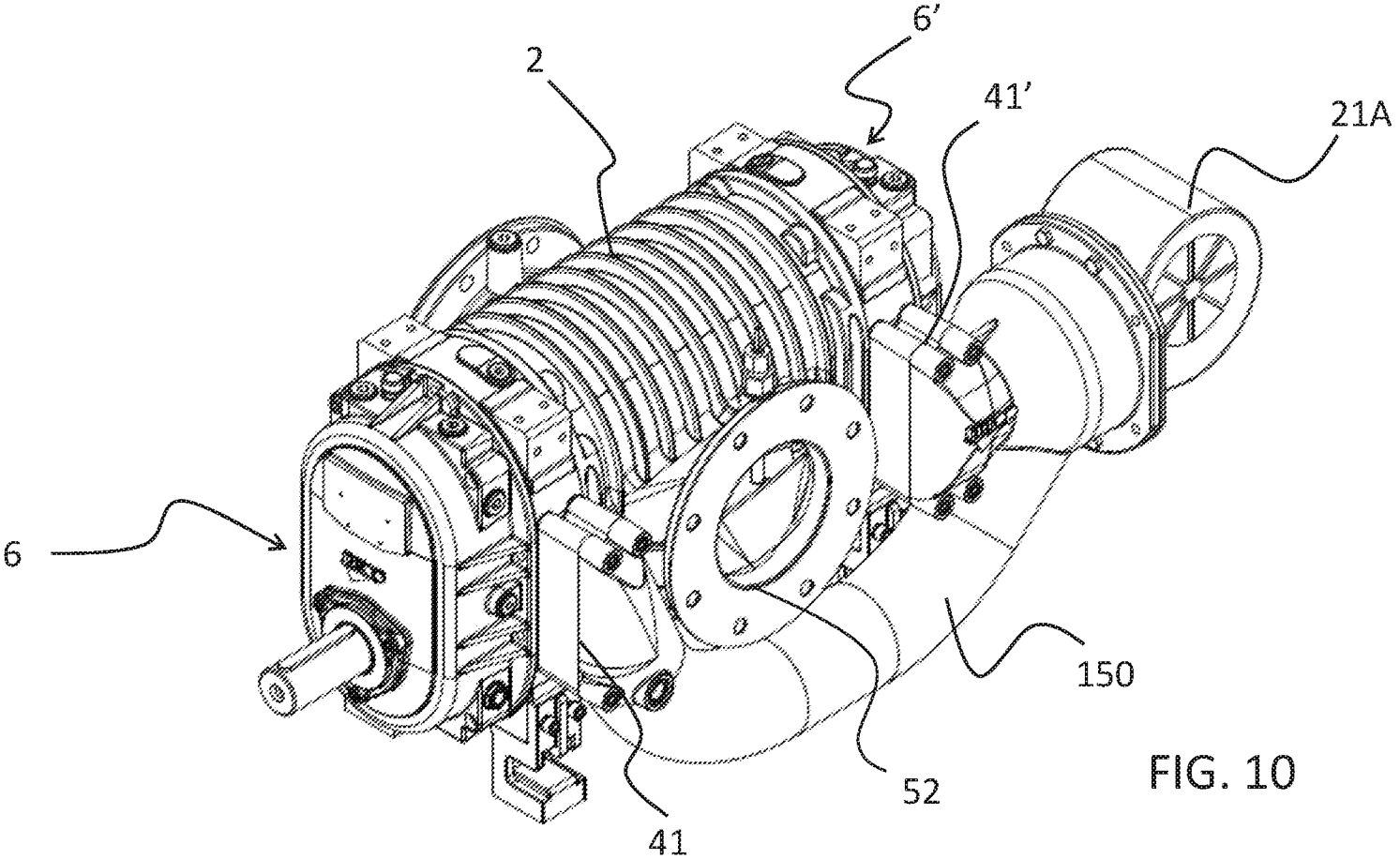
FIG. 10 is a perspective view of a second possible embodiment of a volumetric compressor according to the present invention.

According to a possible embodiment shown in FIG. 10, the flow generator unit can comprise a single operating machine 21A, i.e. one single blower/fan or equivalent, to generate both the flows for the cooling chambers 70, 70'. In this embodiment, the flow generator unit comprises a supply conduit 150 communicating with the operating machine 21A and defining two discharge sections: a first section communicating with the inlet 71 of the first cooling chamber 70 and a second section communicating with the inlet 71' of the second cooling chamber 70'.

As can be seen in FIG. 10, also in this embodiment, two sleeves 41, 41' are provided for connecting each discharge section of the supply conduit 150 to the bank 61, 61' of the corresponding header 6, 6'. Again with reference to FIG. 10, the supply conduit 150 has a partially arc-shaped conformation that enables said conduit to be positioned adjacent to the body 2 of the compressor 1, advantageously below the discharge section 52. In this way, the compressor 1 maintains a relatively compact conformation.

Figure 8:
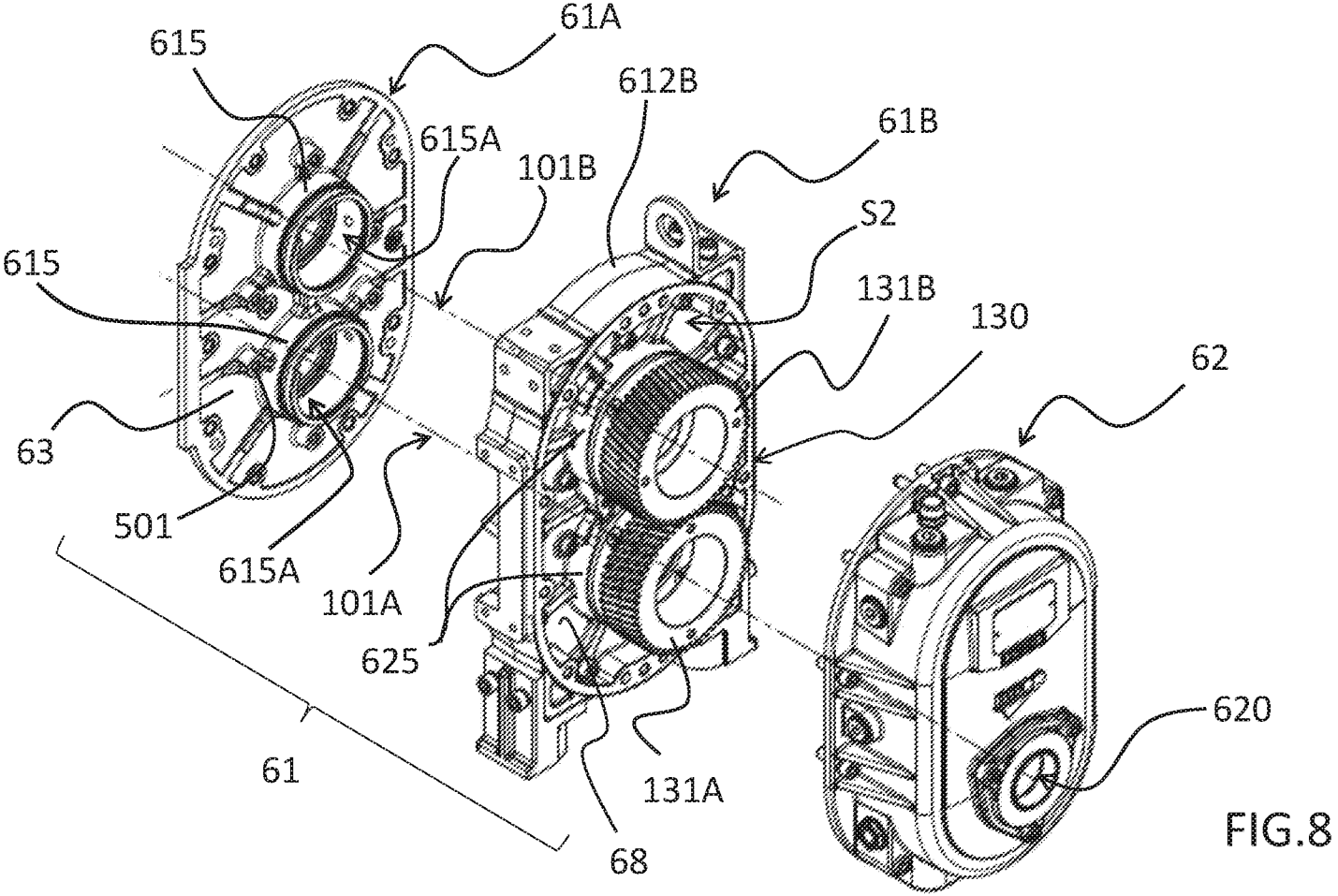
FIGS. 8 and 9 are exploded views from different observation points of a header of the compressor of FIGS. 1 and 2.
Figure 9:
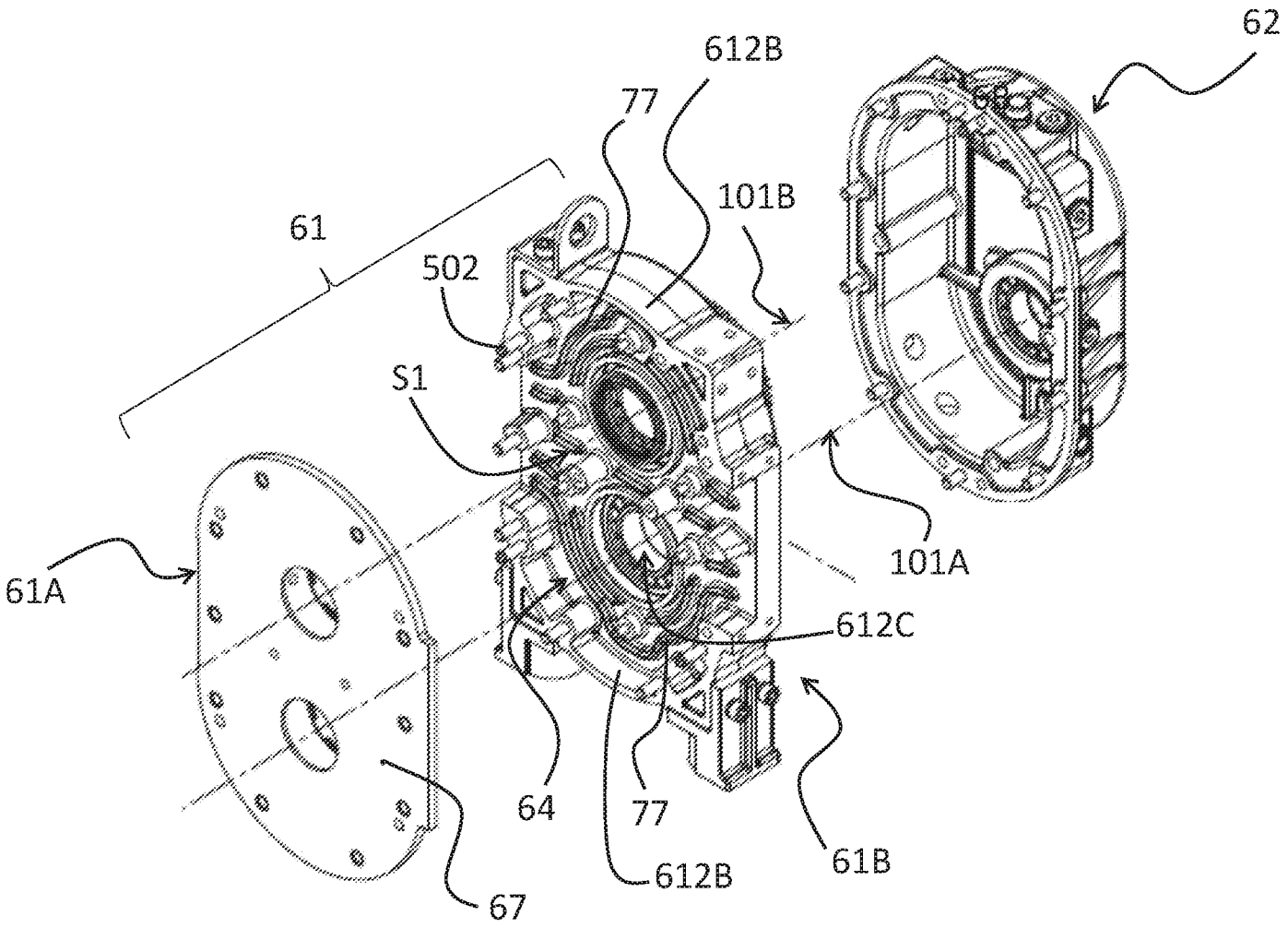

According to a preferred embodiment shown in the figures, for at least one of the two headers 6, 6', the corresponding bank 61, 61' comprises a first portion 61A, 61A' and a second portion 61B, 61B' connected to each other, preferably through screw connection means 501-502 (see FIGS. 8 and 9). The first portion 61A, 61A' is connected to the body 2 and longitudinally delimits the work chamber 5. The second portion 61A, 61B' is connected to the corresponding cover 62, 62' and with it defines the corresponding inner volume 65, 65' of the header 6, 6'.

In the embodiment shown in the figures, the configuration with two portions of the bank 61, 61' is adopted for both the headers 6, 6'. In particular, for each bank 61, 61', the corresponding two portions 61A-61B, 61A'-61B' are configured so as to define, once they have been joined, the cooling chamber 70, 70' in accordance with the purposes of the present invention.

More precisely, the cooling chamber 70, 70' is delimited by an inner side 63, 63' of the first portion 61A, 61A' and by an inner side 64, 64' of the second portion 61B, 61B'. An outer side 67, 67' of the first portion 61A, 61A' longitudinally delimits the work chamber 5, while an outer side 68, 68' of the second portion 61B, 61B' remains in contact with the oil bath delimiting the corresponding inner volume 65, 65' of the header 6, 6'. In short, the term "inner" is used to indicate the sides of the portions 61A, 61B-61A', 61B' of the bank 61, 61' that delimit the relative cooling chamber 70, 70', while the term "onder" is indicated for the sides opposite the inner ones.

According to a possible embodiment, the two portions 61A, 61B-61A', 61B' are made of metallic materials having different thermal conductivity. Preferably, the second portion 61B, 61B' is made of a first material, for example cast iron, having a thermal conductivity greater than a second material, for example steel, with which the first portion 61A, 61A' is made. This solution is designed to favour dissipation of the heat from the oil bath which is in contact with the outer side of the second portion 61B, 61B'. In fact, although on the one hand the gas flow through the cooling chamber 70, 70' subtracts heat also from the body 2, on the other hand this solution favours the heat exchange by convection with the second portion 61B, 61B' of the bank 61, 61' with greater thermal conductivity.

In an alternative embodiment, falling within the present invention, the two portions 61A, 61B-61A', 61B' of the bank 61, 61' could be made of the same material, i.e. have the same thermal conductivity. In another possible embodiment, the material forming the first portion 61A, 61A' could have a thermal conductivity higher than the one used for the second portion 61B, 61B'.

FIGS. 8 and 9 are exploded views of the first header 6 from different observation points and show in detail a possible embodiment of the first bank 61 and in particular of the two component portions 61A, 61B. In the case illustrated, the outer side 67 of the first portion 61A is defined by a flat surface orthogonal to the rotation axes 101A, 101B of the rotors 8A, 8B to delimit in a corresponding manner the work chamber 5. The inner side 63 of the first portion 61A is mainly flat-shaped comprising two support portions 615 that develop towards the second portion 61B to support the end parts 83A, 83B of the rotors 8A, 8B. The support portions 615 are crossed by a cavity 615A housing at least one first support 701 (indicated in FIG. 5) that allows the rotation of a corresponding rotor 8A, 8B.

In the case illustrated, the second portion 61B is defined by a body that comprises a core part 610B (indicated in FIG. 5) defining the inner side 64 and the outer side 68 of the second portion 61B. The latter also comprises a perimeter part 612B (indicated in FIGS. 8 and 9) that surrounds the core part 610B. Preferably, the two parts 610B and 612B are made in one single body. The perimeter part 612B delimits a first housing space S1 (see FIG. 9) that develops from the inner side 64 towards the first portion 61A of the bank 61, and a second housing space S2 (see FIG. 8) that develops from the outer side 68 towards the cover 62. Following the connection with the first portion 61, the first space S1 defines part of the first cooling chamber 70, while the second space S2 defines part of the inner volume 65 for the lubricating bath. On the outer side 68 of the second portion 61B, support portions 625 are defined, wherein they are crossed by a through cavity 612C in which a second support 702 (indicated in FIG. 5) is positioned for the rotation of a corresponding rotor 8A, 8B. Following their connection, the two portions 61A, 61B define the form of the bank 61 in which two sides 91A-91B, substantially opposite with respect to the reference plane 200 defined above, a lower part 91C and an upper part 91D can be identified (see FIG. 4). As can be seen for example from FIGS. 1 and 2, following connection of the two portions 61A, 61B, the inlet 71 and the outlet 72 of the first cooling chamber 70 are defined in the area of the sides 91A, 91B of the first bank 61.

Figures 6, 7:
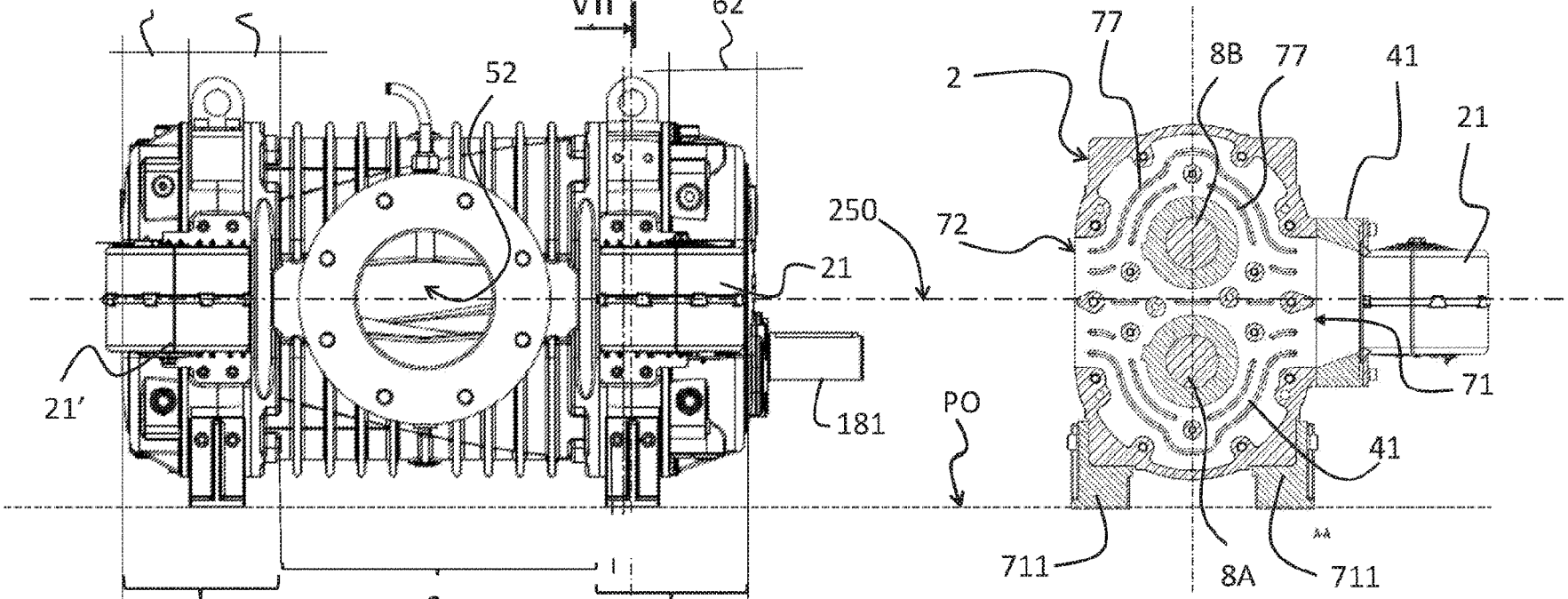
FIG. 6 is a lateral view of the compressor of FIGS. 1 and 2.
FIG. 7 is a section view according to the line VII-VII of FIG. 6.

As shown in the figures, according to a possible embodiment, in the lower part 91C of the bank 61, fixing feet 711 can be installed for fixing the compressor 1 (see FIG. 7). For example, two fixing feet 711 can be provided on opposite sides with respect to the reference plane 200.

In an embodiment, also shown in the figures, in the upper part 91D an eyebolt 715 can be provided to lift the compressor 1 (see FIG. 4).

The technical solutions described above with reference to the first bank 61 of the first header 6 are preferably adopted also for the second bank 61' of the second header 6', as can be seen also from the section view of FIG. 5. Therefore, the above description should be referred to for the structure of the second bank 61'.

According to a possible embodiment, the inner side of one of the two portions 61A, 61B-61A', 61B' of the bank 61, 61' defines ribs 77 which develop towards the inside of the corresponding cooling chamber 70, 70' in order to increase the thermal exchange surface with the cooling gas.

In the embodiment shown in the figures, said ribs 77 are defined on the inner side 64, 64' of the second portion 61B, 61B' of the bank 61, 61'. Also this arrangement is designed to favour dissipation of the heat from the lubricating bath contained in the inner volume 65, 65'. However, in alternative embodiments, the ribs could be provided on the inner side 63, 63' of the first portion 61A, 61A' or on the inner side 63, 64 of both the portions 61A, 61B-61A', 61B' of the bank 61, 61'.

The section view of FIG. 7 shows a possible arrangement of the ribs 77 referring to the first cooling chamber 70 defined in the bank 61 of the first header 6. In detail, said ribs 77 are arranged around the rotors 8A, 8B if evaluated on an observation plane orthogonal to the axis thereof and passing through the cooling chamber 70.

In particular, the ribs 77 develop according to an arrangement reflecting that of the flow lines followed by the cooling gas as it crosses the cooling chamber 70 from the inlet 71 to the outlet 72 thereof. In particular, said ribs 77 are preferably symmetrical with respect to the first reference plane 200 defined above, and likewise with respect to a second reference plane 250 orthogonal to the first reference plane.

The arrangement shown in FIG. 7 and described above should be considered a possible, and therefore non-exclusive, arrangement and/or form of the ribs. The present invention therefore includes the possibility of configuring said ribs differently, and the possibility of defining the same on the inner side of the first portion defining the bank and/or on the inner side of both the portions defining the bank.

According to a possible embodiment, not shown in the figures, the bank 61, 61' of one or both the headers 6, 6' could be made in one single piece. In this case, the cooling chambers 70, 70' of the two banks 61, 61' could be defined directly through a fusion process.

The technical solutions described above fully achieve the predefined tasks and objects. In particular, the main effect of the passage of forced air through the cooling chambers 70, 70' is to limit the thermal level of the lubricating bath contained in the inner volume 65, 65' of the header 6, 6' consequently prolonging the life of the lubricating oil.

Figure 11:
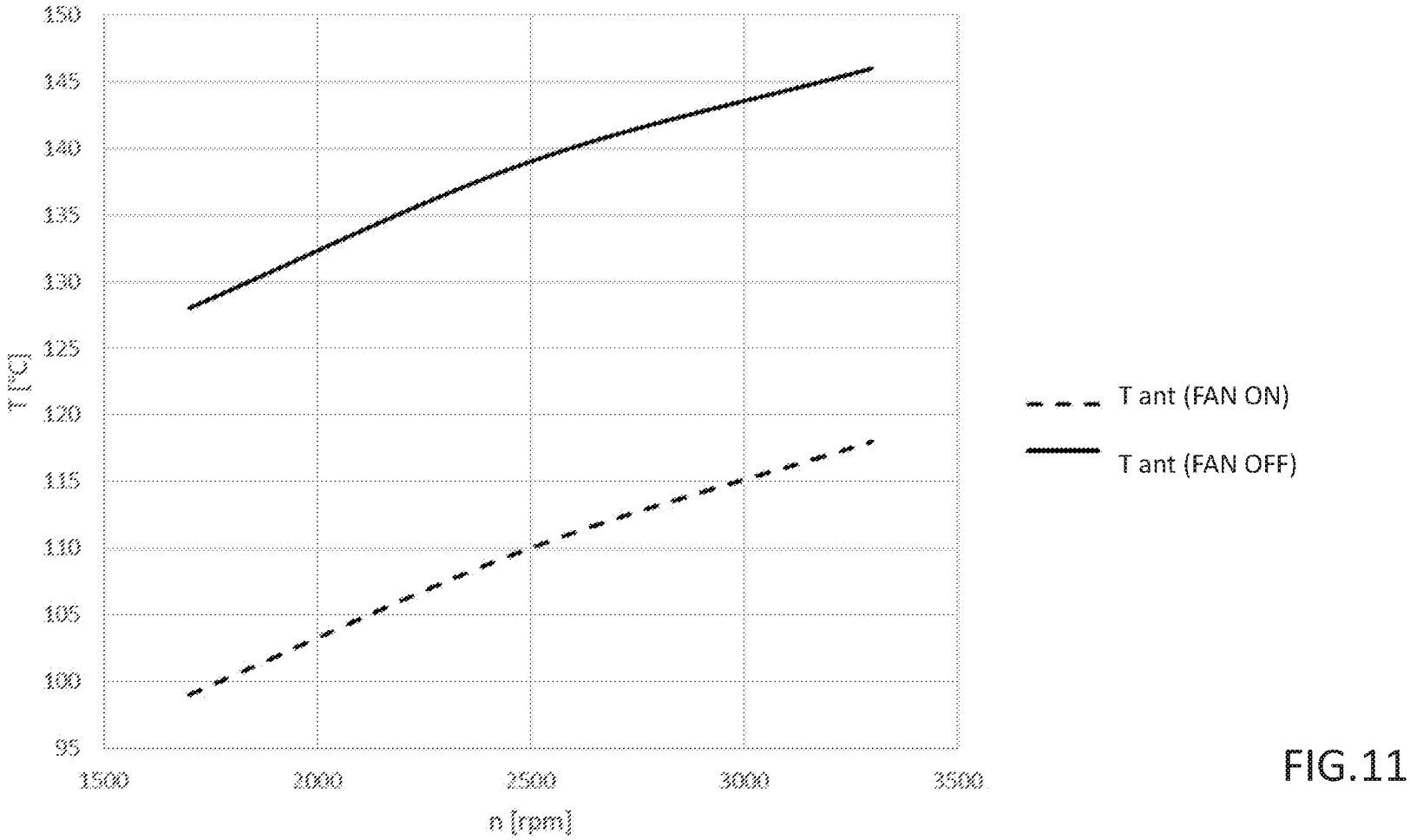
FIGS. 11 to 13 are graphs relative to operation of the compressor of FIGS. 1 and 2.

In this regard, with reference to the compressor 1 shown in the figures, the graph of FIG. 11 shows the trend of the temperature T of the lubricating oil in the inner volume 65 of the first header 6 as a function of the rotation speed. In particular, the continuous line curve shows the trend of the temperature T in the absence of flow (fan/blower deactivated) through the cooling chamber 70, while the broken line curve shows the trend of the temperature T in the presence of a cooling flow (fan/blower activated) through the same chamber. Said temperature is measured by a temperature sensor (thermocouple) inserted in the inner volume 65 in contact with the lubricating oil.

From comparison of the two curves in FIG. 11 it can be seen that the forced flow of cooling gas into the cooling chamber 70 leads to a reduction in the temperature of the lubricating oil by over 20% substantially independently of the number of rotations.

Figure 12:
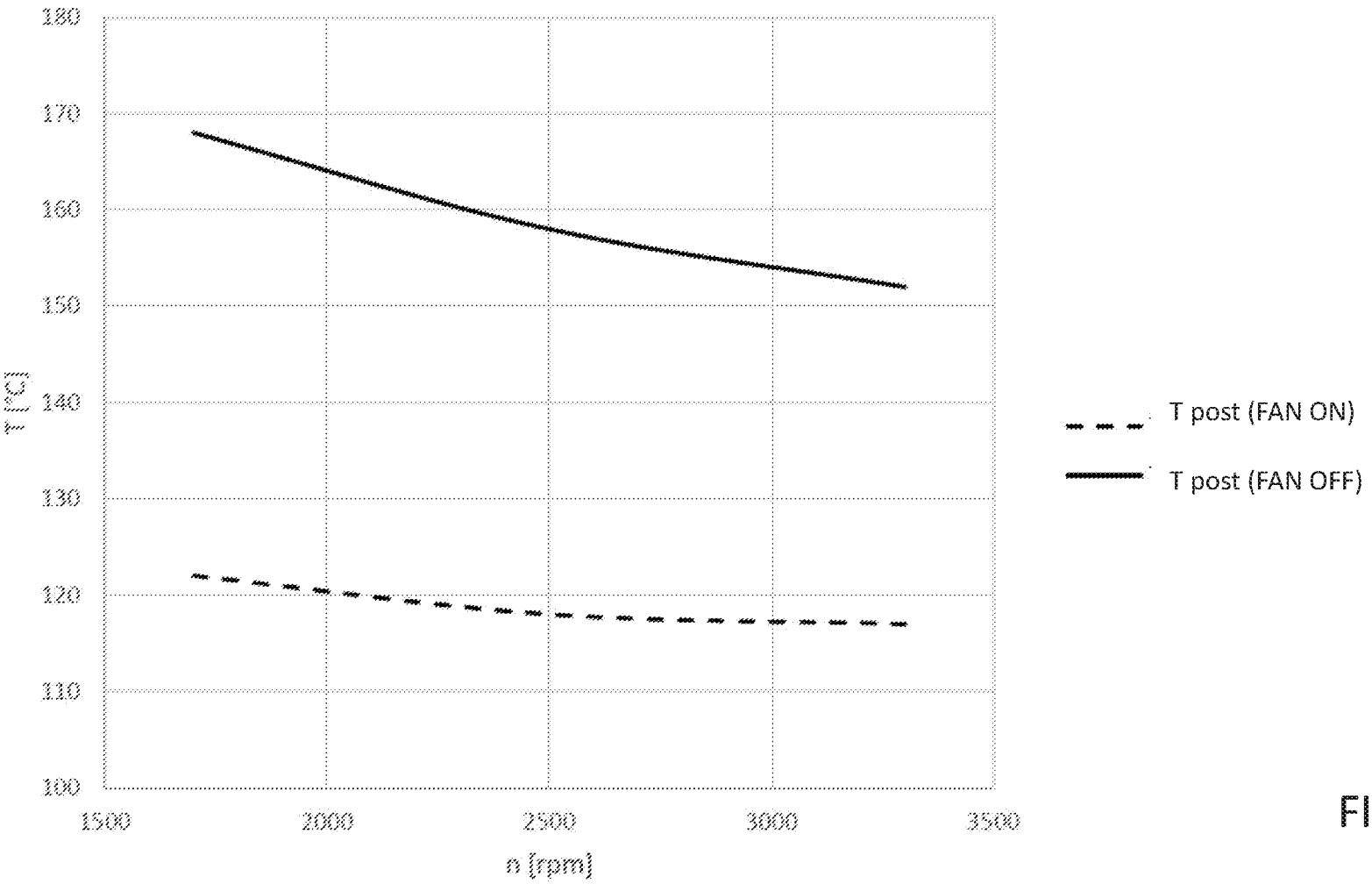

The graph of FIG. 12 refers to heating of the lubricating oil contained in the inner volume 65' of the second header 6'. Also in this case, the two curves shown indicate the temperature trend with variation in the number of rotations, respectively in the absence (continuous line) and in the presence (broken line) of active cooling, i.e. flow of cooling gas, into the cooling chamber 70' defined in the second bank 61' of the second header 6'.

Also from the graph of FIG. 12 a significant reduction in heating of the lubricating oil in the presence of a gas flow through the cooling chamber 70' can be seen. Also in this case, the temperatures drop by over 20% with respect to operation in the absence of forced cooling (i.e. with the flow generator unit deactivated).

Figure 13:
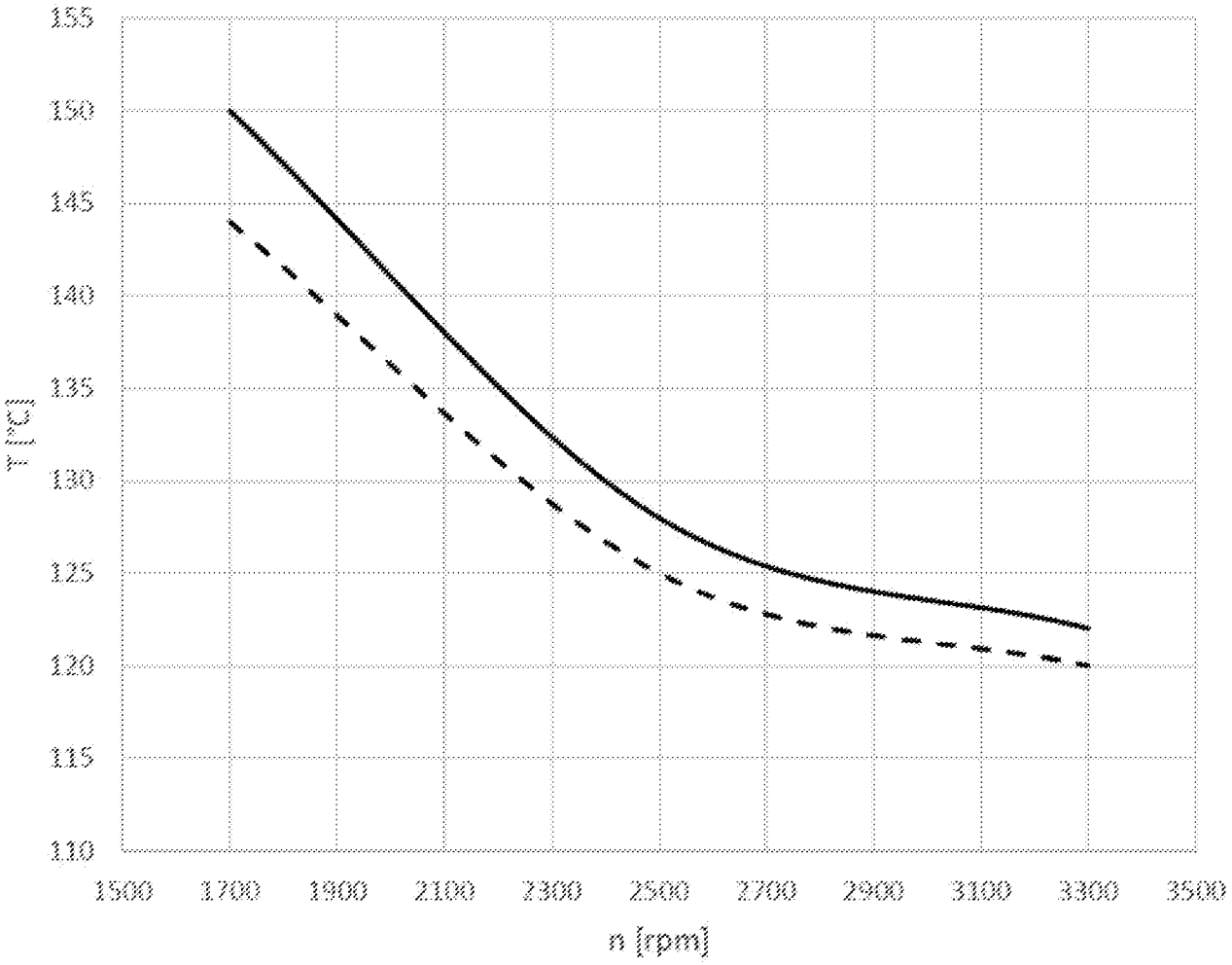

The graph of FIG. 13 refers to heating of the body 2 of the compressor 1 at of the discharge section 52. In particular, the two curves show the temperature trend (again as a function of the rotation speed of the rotors 8A, 8B) in the area of the discharge section 52, respectively in the absence (continuous line) and in the presence (broken line) of a forced flow through the cooling chambers 70, 70'. The graph of FIG. 13 shows lesser heating when the flow generator unit is activated. This is proof that the forced flow of cooling gas through the banks 61, 61' is advantageous also with reference to the lesser heating of the body 2. Advantageously, the lesser heating of the body 2 allows greater efficiency of the compressor 1 and results in increased performance of the compressor. In particular, with respect to the known solutions, in the presence of more limited heating of the compressor 1, in the "in pressure" operating mode it is possible to obtain greater pressures at the discharge section, whereas in the "vacuum" operating mode it is possible to advantageously increase the degree of vacuum.

The invention claimed is:

1. A volumetric compressor comprising:

a body defining an operative chamber, a suction section, and a discharge section of an operating fluid;

at least two lobe rotors, wherein lobes of each of the lobe rotor are housed inside the operative chamber, each of the rotor configured to rotate around a corresponding longitudinal rotation axis;

a first header and a second header that delimit on opposite sides the operative chamber, wherein each of the first and second headers comprises:

a bank connected to the body and configured to support the at least two rotors;

a cover connected to the bank to define an inner volume comprised between the cover and the bank, and configured to house, in use, a lubricating bath; and a generator unit configured to generate a forced flow of cooling gas;

wherein, for each of the first and second headers, the respective bank defines a cooling chamber physically separated from the operative chamber and from the corresponding inner volume, wherein each of the cooling chamber comprises an inlet communicating with the generator unit and an outlet for the cooling gas.

2. The volumetric compressor of claim 1, wherein the inlet and the outlet of the cooling chamber are arranged on opposite sides with respect to a reference plane containing the respective rotation axes of the rotors.

3. The volumetric compressor of claim 2, wherein the outlet of the cooling chamber is defined in a position near the suction section of the body, and the inlet is defined in a position near the discharge section of the body.

4. The volumetric compressor of claim 1, wherein the generator unit comprises at least one operating machine driven independently of the rotors of the compressor.

5. The volumetric compressor of claim 1, wherein the bank comprises a first portion and by a second portion connected to each other to define the cooling chamber, wherein the first portion is connected to the body and the second portion is connected to the cover.

6. The volumetric compressor of claim 5, wherein the second portion is made of a material having a thermal conductivity higher than that of a material of the first portion.

7. The volumetric compressor of claim 1, wherein the bank comprises a first portion and by a second portion connected to each other to define the cooling chamber, and wherein on an inner side of one of the first and second portions, ribs are defined that develop towards an inside of the cooling chamber to increase a thermal exchange surface with the cooling gas.

8. The volumetric compressor of claim 1, wherein the generator unit comprises a first operating machine and a second operating machine, each of which is connected, directly or indirectly, to a corresponding bank wherein an air flow delivery of each operating machine communicates with the inlet of a corresponding cooling chamber.

9. The volumetric compressor of claim 8, wherein the first and second operating machines are arranged on the same side with respect to a reference plane containing the rotation axes of the rotors.

10. The volumetric compressor of claim 8, wherein each of the first and second operating machines is connected to a corresponding bank by the connection sleeve which establishes communication between the delivery of the respective operating machine and the corresponding cooling chamber.

11. The volumetric compressor of claim 1, wherein the generator unit comprises an operating machine and a delivery duct communicating with an air flow delivery of the operating machine and defining two outlet sections, each communicating, directly or indirectly, with an inlet of a corresponding cooling chamber.

12. A system comprising fixed or movable equipment for suction/compression of material in liquid, gaseous, solid, powder, or slurry form, the equipment comprising the volumetric compressor of claim 1.

13. The system of claim 12, wherein the inlet and the outlet of the cooling chamber are arranged on opposite sides with respect to a reference plane containing the respective rotation axes of the rotors.

14. The system of claim 13, wherein the outlet of the cooling chamber is defined in a position near the suction section of the body, and the inlet is defined in a position near the discharge section of the body.

15. The system of claim 12, wherein the generator unit comprises at least one operating machine driven independently of the rotors of the compressor.

16. The system of claim 12, wherein the bank comprises a first portion and by a second portion connected to each other to define the cooling chamber, wherein the first portion is connected to the body and the second portion is connected to the cover, and wherein the second portion is made of a material having a thermal conductivity higher than that of a material of the first portion.

17. The system of claim 12, wherein the bank comprises a first portion and by a second portion connected to each other to define the cooling chamber, and wherein on an inner side of one of the first and second portions, ribs are defined that develop towards an inside of the cooling chamber to increase a thermal exchange surface with the cooling gas.

18. The system of claim 12, wherein the generator unit comprises a first operating machine and a second operating machine, each of which is connected, directly or indirectly, to the corresponding bank wherein an air flow delivery of each operating machine communicates with the inlet of the corresponding cooling chamber.

* * * * *